United States Patent [19]

Matzen

[11] 4,432,704

[45] Feb. 21, 1984

[54] MECHANICAL SPEED REGULATOR FOR AN INJECTION PUMP

[75] Inventor: Max Matzen, Leverkusen, Fed. Rep. of Germany

[73] Assignee: Klöckner-Humboldt-Deutz Aktiengesellschaft, Cologne, Fed. Rep. of Germany

[21] Appl. No.: 327,013

[22] Filed: Dec. 3, 1981

Related U.S. Application Data

[63] Continuation-in-part of Ser. No. 92,991, Nov. 9, 1979, abandoned.

[30] Foreign Application Priority Data

Nov. 11, 1978 [DE] Fed. Rep. of Germany ..... 2849093

[51] Int. Cl.[3] ..... F02D 1/10

[52] U.S. Cl. ..... 417/294; 123/374

[58] Field of Search ..... 417/294; 123/374

[56] References Cited

U.S. PATENT DOCUMENTS 3,219,020 11/1965 Roosa ..... 417/294 X 3,871,794 3/1975 Leblanc ..... 417/294 X 4,132,206 1/1979 Straubel et al. ..... 123/374

FOREIGN PATENT DOCUMENTS 572006 1/1958 Italy ..... 417/294

*Primary Examiner*—Richard E. Gluck

*Attorney, Agent, or Firm*—Becker & Becker, Inc.

[57] ABSTRACT

A mechanical speed regulator for an injection pump which has centrifugal weights on its drive shaft. The centrifugal weights shift the regulator or control pin axially against the force of a starting supplementary feed spring, whereby in operation the control pin additionally is balanced or equalized with a control spring. The control spring is arranged at one end and the control pin is arranged at another end of a beam arranged to swing freely. A suspension of the beam is shiftable in the longitudinal direction of the beam. The suspension of the beam is arranged and embodied practically free of friction, for instance point journalling being provided therewith. The control pin at its free end provides a knife edge which fits into a correspondingly embodied depression or recess in the beam, and the beam has a conical tip elevation for receiving the control spring. An adjustable abutment is provided in the form of a set screw on the beam in the axial extension of the control spring. The preloading of the control spring is adjustable in a freely selectable manner by a speed adjustment lever arranged externally on the regulator housing.

8 Claims, 1 Drawing Figure

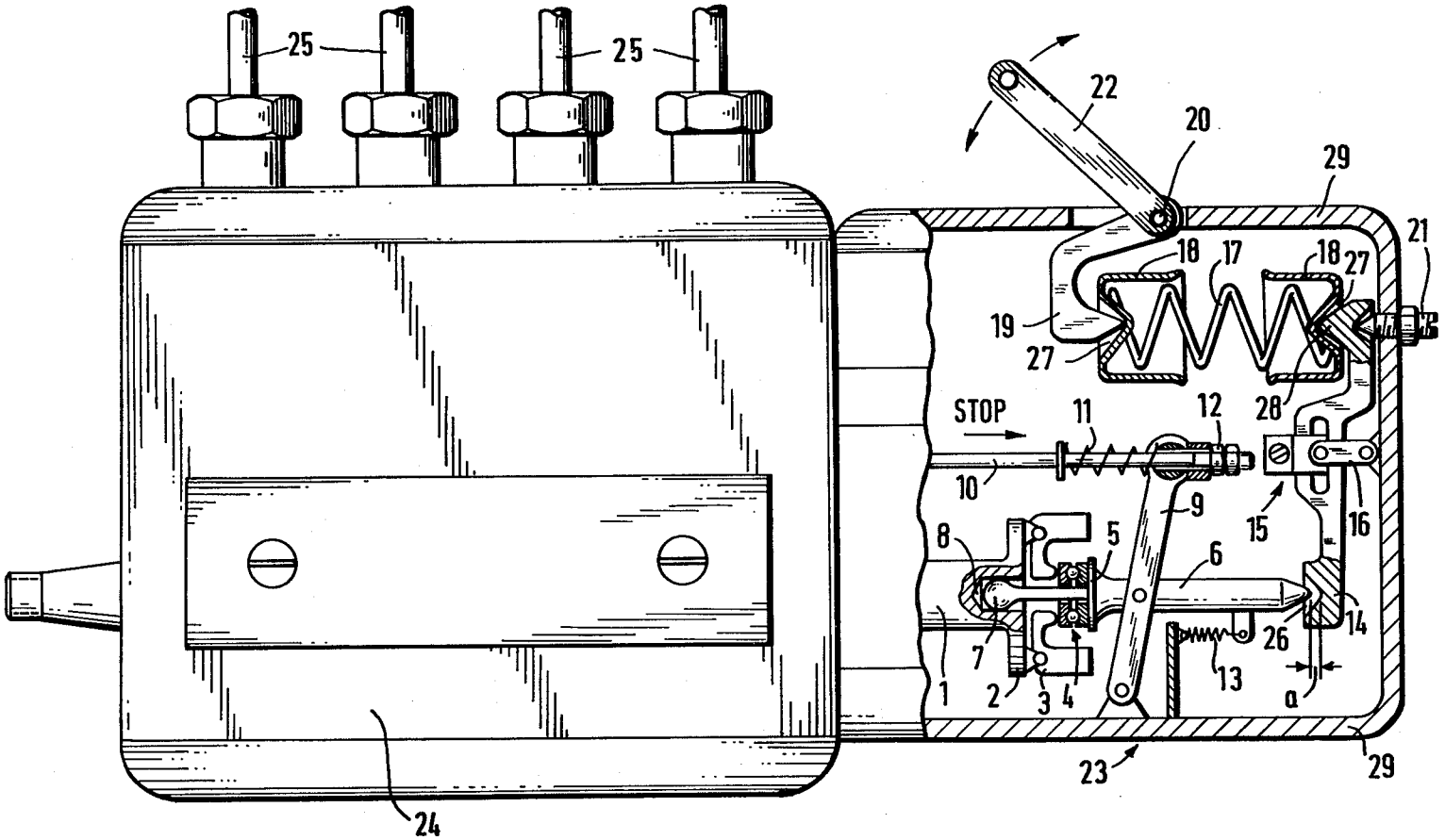
STOP
a

MECHANICAL SPEED REGULATOR FOR AN INJECTION PUMP

CROSS-REFERENCE TO RELATED APPLICATION

This is a continuation-in-part of co-pending application Ser. No. 92,991-Matzen, filed Nov. 9, 1979, now abandoned.

BACKGROUND OF THE INVENTION

1. Field of the Invention

The present invention relates to a mechanical speed regulator for an injection pump which has centrifugal weights on its drive shaft. The centrifugal weights shift a regulator or control pin axially against the force of a supplementary feed spring, whereby in operation there is one end of a beam of balance arranged to swing freely and to engage the control pin furthermore in balance or equilibrium with a regulator spring.

With mechanical speed regulators it is desirable that the control spring exerts its force with the least possible friction upon the control pin, since otherwise the control or regulation accuracy suffers. For constructive reasons, as well as because of the proportionality range adjustment and the automatic procedure or steering of the quantity, it is, however, not possible to permit the control spring to engage directly against the pin. Consequently, intermediate members are necesssary, which once again effect friction and damping of the spring force therewith.

2. Description of the Prior Art

As to the arrangement of a speed regulator, reference can be made to U.S. Pat. No. 4,132,206-Straubel et al, issued Jan. 2, 1979 for a schematic representation that shows the elements of a speed regulator or speed control including a portion of a housing and there can be generally stated that the speed regulator or control is connected with a block injection pump. The Straubel et al Patent 4,132,206 described accurately how the speed regulator functions and what a starting supplementary quantity or feed actually is, namely, that the associated fuel injection pump delivers a starting fuel rate exceeding the full-load fuel rate, with excess being maintained while starting the engine up to a predetermined point. An average man skilled in the art who is active in such a field of endeavor must understand in principle how such devices are constructed. However, instead of referring to "starting supplementary feed", then there can be attributed the meaning thereto—extra quantity of fuel needed for starting—. With the Straubel et al patent, the transfer of the forces from the control spring onto the control rod occurs by way of a complicated mechanism with several bearing locations and guide means which all are frictionally loaded or burdened. Consequently, no transfer of the position of the control spring onto the control rod can occur free of losses. Such a system operates with large losses and this means that a small or nominal change of speed of the internal combustion engine is not at all noticed by such a control system and correspondingly also is not balanced or equalized. Disadvantageous with the arrangement of U.S. Pat. No. 4,132,206-Straubel for a mechanical speed regulator is that the forces of the regulator springs must be transferred to the regulator pin by a complicated and friction-loaded or burdened kinematic arrangement. Additionally, the beam of balance is linked simultaneously in the middle region thereof and is adjusted by a very complicated embodiment of adjustment device whereby the beam of balance is loaded in such a manner that in the point of adjustment and in both linkage points positively an increased friction must arise. Such a system operates with great losses. This means that a slight change of the speed of the internal combustion engine is not at all noted or detected by such a control or regulating system and consequently, also cannot be equalized thereby.

The remaining prior art shows no separate speed control or regulator but rather distributor injection pumps with integrated speed regulator or control means. Because of the manner of construction of the distributor pumps there exists no control rod in the conventional sense but rather either the pump drive shaft is shifted so that the pump stroke is changed or valves are actuated which change the invention quantity flowing into the cylinder. For this reason such speed regulator or control means are not comparable with those of the present invention. Accordingly, the Leblanc U.S. Pat. No. 3,871,794 dated Mar. 18, 1975 shows a distributor injection pump with a very complicated arrangement including bearing means and pump elements driven by way of the drive shaft having a frictional force exerted upon the shaft so that the axial shifting thereof certainly is not possible in a fine or sensitive manner nor being possible in small steps.

Approximately the same relationships are shown by the Roosa U.S. Pat. No. 3,219,020 dated Nov. 23, 1965 which fails to recognize that it is not sufficient only to journal the lever having a low friction but rather that it is necessary to arrange all elements, to have low friction so that a transfer of a centrifugal force movement is permitted onto the control elements changing the injection quantity with a low friction. Also, with the Roosa patent there is disadvantageous that a valve is arranged in a bore without other auxiliary means and a rotation of the valve consequently is frictionally burdened or loaded.

The Italian Pat. No. 572,006 of Jan. 18, 1958 likewise shows in a manner similar to both foregoing patents only a distributor injection pump involving all steps or procedures which are frictionally burdened or loaded and that require a relatively high cost or application of force. This however is not compatible with a fine or sensitive adjustment as can be created with the features of the present invention. Attention is directed thereto that the three last mentioned disclosures do not show any speed regulator or control as described by the present invention.

SUMMARY OF THE INVENTION

It is therefore an object of the present invention to provide a mechanical speed regulator for an injection pump of an internal combustion engine which permits transfer of the force of the control spring to the control pin with the least possible friction. If the control pin and regulation spring engage the scale balance or beam of balance, accordingly the force balance on the beam can be further increased in the accuracy thereof.

The speed regulator of the present invention is characterized primarily in that the control spring engages at one end and the control pin engages at the other end of a beam arranged to swing freely. With this, still only one element is interconnected between the control pin and the control spring. This element provides a single bearing location in which friction and therewith damping of the spring force can arise. Consequently, the operating accuracy of the regulator is considerably increased.

If the control spring is embodied as a pressure spring and arranged parallel to the control pin and provides the same direction of force as the control pin, a compact regulator housing is created in which relatively large forces can be transmitted or transferred without force and with a minimum of friction. Consequently, it is furthermore possible to use a spring with a linear characteristic or curve since the force direction thereof is parallel to the control pin.

For the purpose of being able to adjust the transmission or transfer ratio between the control pin and the force of the control spring, it is additionally proposed to arrange the suspension of the beam adjustably in the longitudinal direction of the beam. With this, it is possible to change the degree of proportionality of the regulator.

A further reduction of the friction is attained thereby that the beam is journalled practically frictionless, for instance, in a point suspension or point support or upon a knife edge.

If the control pin and the control spring engage the beam with such a knife edge engaging into a correspondingly embodied depression or groove in the beam having a point conical elevation or projection for receiving the control spring, then the force comparison on the beam can be further increased with regard to the accuracy thereof.

By mounting an adjustable abutment in the axial extension of the control spring on the beam, there is attained the advantage that stepless adjustment of the supplementary feed during starting is made possible.

So that the preloading of the control spring is not influenced by the adjustment of the supplementary feed during starting, it is proposed according to a further development of the invention to adjust the preloading of the control spring by a separate speed adjustment lever arranged externally on the housing. For this purpose, a separate construction or part is provided for the adjustment of the preloading so that every regulator curve or characterizing line can be attained.

For turning off the combustion machine by hand over the speed regulator, it is further proposed that the regulator rod be adjusted over an externally operable turn-off device in the sense of turning-off the machine.

The object of the present invention is to propose a mechanical speed regulator for an injection pump of an internal combustion engine which permits a transfer of force of the regulating spring to the regulator needle or pin in a manner as free of friction as possible. This object is met and resolved thereby that on the other end of the beam of balance the regulator spring embodied as a pressure spring engages therewith which is arranged parallel to the regulator pin with the same force direction as the regulator pin and that the suspension of the beam of balance is made having a tip or peak journalling or bearing as free of friction as possible.

The object of the present invention is met thereby that the regulator spring embodied as a pressure spring engages at the other end of the beam of balance and this regulator spring is arranged parallel to the regulator pin or needle with the same or indentical force direction as the regulator pin or needle and furthermore that the suspension of the beam of balance is embodied as a frictionless point support, pivot-point suspension or jewel. Additionally, by way of the parallel arrangement of the regulator spring and the regulator pin or needle with the same force direction there can be created a compact regulator housing in which relatively great forces can be transferred or transmitted with low friction and in an unrestrained manner.

This object, and other objects and advantages of the present invention, will appear more clearly from the following specification in connection with the accompanying drawing, which illustrates schematically a mechanical speed regulator, for injection pumps, having features in accordance with the present invention.

BRIEF DESCRIPTION OF DRAWING

IN THE DRAWING:

The FIGURE of the drawing shows a partially sectioned fragmentary elevational view of a mechanical speed regulator for an injection pump having features in accordance with the present invention. The drawing illustrates how the elements of the control or regulator are arranged in a fixed housing and are installed or attached to a series injection pump.

DETAILED DESCRIPTION

Referring now to the drawing in detail, the inventive mechanical speed regulator 23 is arranged at the output end of a camshaft 1 of an injection pump 24, not shown in further detail. The end face of the camshaft 1 provides a flange 2 which on its front side has two centrifugal weights 3 rotatably journalled thereon. The centrifugal weights 3 are embodied having an L-form and engage with the short arms or legs thereof against a bearing ring of an axial bearing 4.

The axial bearing 4 engages against a collar or shoulder 5 which is formed by a control pin 6. The control pin 6 provides a guide stud 7 extending axially through the axial bearing 4 in a direction toward the camshaft 1; a ball or spherically formed end of the guide stud 7 is guided in a blind-hole bore 8 in the camshaft 1.

A lever 9 is provided which is connected with the control rod 10 by means of the spring 11, which provides a constant curve or characterizing line over a large range or path. This lever 9 is provided to transmit the movement of the control pin 6 to the control rod 10 connected with a device to adjust quantity being delivered. The time of full-load turning-off is set by way of both counter nuts 12. The lever 9 is rotatably secured on the control pin 6 in conformity with the desired transmission ratio between the control needle and control rod movement.

The other end of the lever 9 is journalled in the housing. Furthermore, provision can be made that a turning-off device engages on the control rod 10 from outside the housing; the control rod 10 can be moved in a direction toward "stop" by way of the turning-off device.

The control pin 6, and thereby also the centrifugal weights 3, are drawn into rest position by the spring 13 for the supplementary feed during starting. The free end of the control pin is made conically pointed and is arranged with a spacing "a" from the beam 14, which has a depression or groove corresponding to the control pin tip or tapered end. The depression is so embodied that with the control pin 6 only a point-formed engagement surface is provided.

The vertically arranged beam 14 is connected by a point journal 15 with a horizontal rocker arm 16 which in turn is fastened in the housing 29 of the speed regulator. The other end of the beam 14 is engaged by the control spring 17. The ends of the control spring 17 are arranged in pots or cup-shaped members 18 which provide an inwardly bent, conically-pointed bottom. The beam end is likewise embodied with an elevated tip or pointed form 28 so that only a point-formed engagement surface or point of contact exists with the corresponding spring pot or cup-shaped member 18. The other end of the spring is held under preload by a suspension arm or link 19 which is connected by a pivot point 20 with the housing 29 of the speed regulator 23. The level of the preload is adjusted by a speed adjustment lever 22 which engages against the bearing or journalling means of the suspension arm of link 19. The speed adjustment lever 22 is hereby arranged advantageously externally of the regulator housing 29 of the speed regulator 23 so that the lever 22 is accessible by operating personnel.

The spacing "a", the size of which determines the supplementary feed during starting, is adjusted between the control pin 6 and the beam 14 with a set screw 21 which is arranged in the housing of the speed regulator and provides with the beam 14 likewise only a point-formed engagement. However, every reaction of the setting of the set screw 21 upon the preloading of the control spring 17 can be equalized by the speed adjustment lever 22.

The transmission ratio between the control spring 17 and the control pin 6 is fixed by the point of engagement of the rocker arm 16 on the beam 14 which can be shifted within certain limits with the suspension of point journal 15.

The regulator described here is in rest position, which means, the combustion machine supplied with fuel by the injection pump 24 is turned off. For this reason, the control rod 10 is shown in its extreme position, which means, during starting of a combustion machine, the injection pump delivers a supplementary feed during starting. As soon as the camshaft of the injection pump exceeds the starting speed, the centrifugal weights 3 move outwardly so that the tip of the control pin 6 engages against the beam 14 and the spacing "a" is zero. The control rod 10 is shifted by the lever 9 by the movement of the control pin 6 in axial direction by a spacing or distance "a" and such shifting occurs in such a manner that the supplementary feed during starting no longer reaches the combustion engine. With a further increase of the speed, the centrifugal weights 3 are moved or diverted outwardly. Consequently, the control pin 6 operates by way of the beam 14 against the force of the control spring 17. Consequently, according to the point of engagement of the rocker arm 16 against the beam 14, there is provided a desired force transmission ratio between the centrifugal weights 3 and the control spring 17.

Every movement of the control pin 6 in axial direction simultaneously shifts the control rod 10 which controls the injection quantity in the injection pump 24. With increasing speed of the combustion machine and the camshaft 1 therewith, the control pin 6 is shifted by means of the centrifugal weights 3, and the control rod 10 is shifted therewith, so long against the force of the control spring 17 until the greatest permissible shifting of the control rod 10 and control pin 6 is attained. Under these circumstances, the combustion engine has the maximum permissible speed. With a further speed increase, the control rod 10 reaches the point where the conveyed quantity returns to null or zero in the injection pump. Under these circumstances, the speed of the combustion machine drops and also the speed of the camshaft 1 drops therewith, so that the control rod 10 is retracted again by way of the control pin 6. The level of full-load injection quantity can be adjusted by the pair of counter nuts 12.

By way of the articulated suspension of the control spring 17 as well as the tip journalling thereof on the suspension 19 and the beam 14, it is possible for it to follow practically without force or constraint and friction every movement of the beam 14.

The drawing in the present case designates those elements which belong to the fixed or rigid housing.

The control rod 10 is connected by way of a lever 9 with the control pin 6. Every deflection of the control pin 6 out of the illustrated position is effective by way of the lever 9 thereby that the control rod 10 likewise is shifted. The lever 9 is at least mentioned for clarification purposes in view of the foregoing to explain relative to what the control rod 10 is pivotally journalled.

There is set forth once again briefly the function of the regulator or control generally and especially the features of the regulator or control proposed in accordance with the present invention. The arrangement illustrated in the drawing is reached in rest or unoperated position of the internal combustion engine. If the internal combustion engine is started, accordingly on the basis of the position of the control rod illustrated in the drawing there is injected an extra quantity of fuel needed for starting (starting supplementary feed) so that the internal combustion engine can start. As soon as the engine has started, on the basis of the now existing idling speed the centrifugal weights 3 are deflected or pivotally outwardly so that the control pin 6 is shifted by a distance "a". Consequently the control rod 10 is also shifted by way of the lever 9 so that the extra quantity of fuel needed for starting is throttled back and there is now still only injected the fuel quantity necessary for idling. The control spring 17 can now be influenced by way of the speed adjustment lever 22. Respectively according to the direction of influencing, the scale balance or beam of balance 14 is more strongly loaded or relieved. In the event that the scale beam 14 is loaded more strongly by way of the control spring 17, the centrifugal weights 3 cannot shift the control pin 6 any further with the scale beam 14 against the force of the control spring 17. In this situation the injected fuel quantity remains unchanged and the speed of the internal combustion engine likewise remains unchanged. If the control spring 17 is relieved by way of the speed adjustment lever 22, accordingly the centrifugal weights 3 shift the control pin 6 further against the scale beam 14 because the centrifugal weights 3 on the basis of centrifugal want to swing or pivot ever further outwardly than permitted by the control pin 6 on the basis of the control spring 17. Consequently the control rod 10 is likewise further shifted by way of the lever 9 so that more fuel material is injected and the motor operates faster.

On the other hand, with such a speed regulator it is also possible to keep the speed of the internal combustion engine constant independently of load fluctuations. This can be important for example with combustion engines which are coupled with a generator for power or current generation when the delivered voltage or frequency is dependent upon the load of the generator. This however can fluctuate though cannot be permitted to change the speed of the internal combustion engine thereby. For this purpose a predetermined preloading upon the control spring 17 is given by way of the speed adjustment lever 22 and this preloading of the control spring 17 corresponds to a predetermined position of the control needle 6 and accordingly of the control rod with a predetermined loading. If now the loading changes, the preloading is for example increased and accordingly the internal combustion engine speed decreases or slows down. Consequently the centrifugal weights 3 are changed in the positioning thereof. In this example the control needle 6 is pushed back or retracted thereby and accordingly also the control rod 10. Consequently more fuel is injected into the internal combustion engine so that the engine again can increase the speed and bearing life, working service or durability thereof and can adapt to new output or capacity requirements. Consequently the speed of the combustion engine is kept constant.

If this function is visualized accordingly it is apparent that the speed regulator reacts only in the fine or sensitive manner to changes of speed of the combustion engine or reacts to prescribed speed changes on the basis of an adjustment of the adjustment lever when these changes are transferred with as little friction as possible and without loss onto the position of the control rod 10.

At this point the features of the present invention take effect. The present invention comprises a speed regulator with which the individual elements are so journalled that if possible a nominal friction arises. For this purpose a scale beam is arranged between the control spring 17 of the control pin 6 and this beam only requires a single bearing location. As also shown by the drawing illustration, the control or regulator is constructed in a very similar manner. All bearing locations are so embodied that substantially only one point-formed engagement exists so that the friction is reduced to a minimum.

The speed regulator or control of the present invention is flanged to the pump housing of block injection pumps and is suitable only for the purpose of adjusting a control rod which actuates special quantity control elements in the injection pump.

For the average man skilled in the art who sees the structural elements of the mechanical speed regulator or control in conjunction with the description and the drawing illustrations, there is made clear with certainty how the structural elements are effective or cooperate together with an injection pump connected to the control or regulator.

In the illustration, there is schematically illustrated a mechanical speed regulator 23 for an injection pump 24 of an internal combustion engine. This injection pump 24 is connected in a conventional manner by injection conduits 25 with injection nozzles or jets of the internal combustion engine. The speed regulator 23 has a housing 29 and in this situation is arranged at the output end of the camshaft 1 of the injection pump 24.

A lever 9 is provided to transfer the movement of the regulator pin or needle 6 onto a control rod 10 which in a conventional manner is connected with a feed or conveying-quantity adjustment device of the injection pump 24. An over-elevation 28 is provided in a peak or point shaped configuation of the beam of balance end so that a spring pot or cup-shaped member 18 has only a point-shaped engagement surface. The other end of the spring is held under pre-load by a suspension arm or link 19 which is connected by a pivot point 20 with the housing 29 of the speed regulator 23 and the spring pot or cup-shaped member 18 engages in the conically-tipped bottom 27 of the oppositely located spring pot or cup-shaped member 18.

The present invention is, of course, in no way restricted to the specific disclosure of the specification and drawing, but also encompasses any modifications within the scope of the appended claims.

What is claimed is:

1. A mechanical speed regulator for an injection pump, which comprises in combination a housing for said regulator flanged thereto;

a drive shaft operatively connected to said pump;

centrifugal weights operatively connected to said drive shaft;

a control pin operatively connectible to said drive shaft;

a supplementary extra-starting-fuel feed spring operatively connected to said housing and to said control pin, said control pin being adapted to be axially shifted by said centrifugal weights against the force of said supplementary feed spring;

control spring means operatively connected to said housing, said control pin being substantially in equilibrium with said control spring means during operation of said regulator;

a beam operatively connected to said housing in such a way as to be able to swing freely relative thereto, said beam having a first end and a second end, said first end being adapted to engage said control pin, and said second end engaging said control spring means, said control spring means being a pressure spring arranged in such a way that its central axis is substantially parallel to said control pin and that it is adapted to have the said direction of force as said control pin, said housing including an adjustable stop located substantially coincidental with the extension of the central axis of said pressure spring, said second end of said beam being interposed between said pressure spring and said stop and being adapted to be engaged by said stop.

2. A regulator in combination according to claim 1, which includes a control rod pivotally connected to said control pin, and a turning-off device operatively connected to said control rod and operable for pivoting said control rod from outside said housing.

3. A regulator in combination according to claim 1, which includes a mounting member pivotally connected to said housing and journalled in said beam in such a way as to be displaceable substantially in the longitudinal direction thereof.

4. A regulator in combination according to claim 3, in which said mounting member includes a practically frictionless support to said beam.

5. A regulator in combination according to claim 4, in which said mounting member includes a point support to said beam.

6. A regulator in combination according to claim 1, in which that end of said control pin remote from said drive shaft includes an edge that fits in and engages a corresponding depression in said first end of said beam, and in which said second end of said beam includes a pointed conical projection for receiving said pressure spring.

7. A regulator in combination according to claim 1, in which said control spring means further includes a speed adjustment lever mounted to and externally of said housing and adapted to engage said pressure spring for freely selectable preload adjustment thereof.

8. A regulator in combination according to claim 1, in which said stop is a set screw.

* * * * *